US009919234B1

(12) United States Patent
Powell

(10) Patent No.: US 9,919,234 B1
(45) Date of Patent: Mar. 20, 2018

(54) WALL-MOUNTABLE TOY STORAGE AND ACTIVITY SET WITH THREE-DIMENSIONAL MAGNETIC INDICIA

(71) Applicant: Rochelle Powell, Ramsey, MN (US)

(72) Inventor: Rochelle Powell, Ramsey, MN (US)

( * ) Notice: Subject to any disclaimer, the term of this patent is extended or adjusted under 35 U.S.C. 154(b) by 0 days.

(21) Appl. No.: 15/394,032

(22) Filed: Dec. 29, 2016

Related U.S. Application Data

(60) Provisional application No. 62/272,654, filed on Dec. 29, 2015.

(51) Int. Cl.

| | |
|---|---|
| ***A63H 3/52*** | (2006.01) |
| ***A63H 33/26*** | (2006.01) |
| ***A63H 33/00*** | (2006.01) |
| ***A63H 3/00*** | (2006.01) |
| ***A63H 33/04*** | (2006.01) |

(52) U.S. Cl.
CPC ..... *A63H 33/003* (2013.01); *A63H 3/00* (2013.01); *A63H 3/52* (2013.01); *A63H 33/046* (2013.01); *A63H 33/26* (2013.01)

(58) Field of Classification Search
CPC ..... A63H 3/08; A63H 3/52; A63H 33/046; A63H 33/26
See application file for complete search history.

(56) References Cited

U.S. PATENT DOCUMENTS

| | | | | | |
|---|---|---|---|---|---|
| 3,093,919 | A * | 6/1963 | Holtz | G09F 7/04 | 250/483.1 |
| 3,955,307 | A * | 5/1976 | Payton | A63H 33/00 | 446/92 |
| 4,233,778 | A * | 11/1980 | Lemelson | A63H 3/52 | 40/426 |
| 4,952,153 | A * | 8/1990 | McAllister | A63F 9/10 | 434/168 |
| 5,178,573 | A * | 1/1993 | Smith | A63H 3/08 | 428/16 |
| 5,478,085 | A * | 12/1995 | Canner | A63F 3/00694 | 273/239 |
| 6,604,976 | B2 * | 8/2003 | Lenkoff | A63H 33/26 | 446/139 |
| 7,690,963 | B2 * | 4/2010 | Whitehead | A63H 33/26 | 446/129 |
| 2010/0159793 | A1 * | 6/2010 | Pittenturf | A63H 33/26 | 446/72 |

* cited by examiner

*Primary Examiner* — John Ricci
(74) *Attorney, Agent, or Firm* — Faegre Baker Daniels LLP

(57) ABSTRACT

A toy storage and activity apparatus includes a housing including a left housing portion and a right housing portion forming an interior volume, and a hinged joint connecting the left and right housing portions. The hinged joint enables separation of the housing into an open configuration to provide access to the interior volume. The left and the right housing portions each form one or more magnetic interior compartments within the interior volume. The magnetic interior compartments have magnetic surfaces suitable for attaching a magnetic toy character and other magnetic toy models. The three-dimensional magnetic surfaces further include interior-facing indicia depicting a scene or imagery.

27 Claims, 7 Drawing Sheets

WALL-MOUNTABLE TOY STORAGE AND ACTIVITY SET WITH THREE-DIMENSIONAL MAGNETIC INDICIA

This application claims the benefit of U.S. Provisional Application No. 62/272,654, filed Dec. 29, 2015, the entire contents of which are incorporated by reference herein for all purposes.

TECHNICAL FIELD

This disclosure relates to storage and organization using magnetics, such as storage and organization of toys.

BACKGROUND

After playtime is over, children often leave their toys on their floor, creating a cluttered mess around the room. Other people may even accidently step on or trip over the toys, hurting themselves or damaging the toys. Additionally, without any creative stimulation, children may resort to watching television or playing video games. Thus, there is a need for an organized toy that is mountable on a wall, wherein the toy provides entertainment for children while fostering creativity and imagination.

SUMMARY

This disclosure includes a wall mountable a toy storage and activity apparatus with a housing forming an interior volume having one or more magnetic interior compartments. The magnetic interior compartments have magnetic surfaces suitable for attaching a magnetic toy character and other magnetic toy models, such as a variety of characters, people, places and things, which enable users to create a variety of different scenes and imagery in the interior compartments, thereby entertaining them and stimulating their creativity and imagination.

In one example, this disclosure is directed to a toy storage and activity apparatus includes a housing including a left housing portion and a right housing portion forming an interior volume, and a hinged joint connecting the left and right housing portions. The hinged joint enables separation of the housing into an open configuration to provide access to the interior volume. The left and the right housing portions each form one or more magnetic interior compartments within the interior volume. The magnetic interior compartments have magnetic surfaces suitable for attaching a magnetic toy character and other magnetic toy models. The three-dimensional magnetic surfaces further include interior-facing indicia depicting a scene or imagery.

In another example, this disclosure is directed to a toy storage and activity set comprising a plurality of magnetic toy characters, and a toy storage and activity apparatus. The toy storage and activity apparatus includes a housing including a left housing portion and a right housing portion forming an interior volume, and a hinged joint connecting the left and right housing portions. The hinged joint enables separation of the housing into an open configuration to provide access to the interior volume. The left and the right housing portions each form one or more magnetic interior compartments within the interior volume. The magnetic interior compartments have magnetic surfaces suitable for attaching a magnetic toy character and other magnetic toy models. The three-dimensional magnetic surfaces further include interior-facing indicia depicting a scene or imagery.

DETAILED DESCRIPTION

Figure 1:
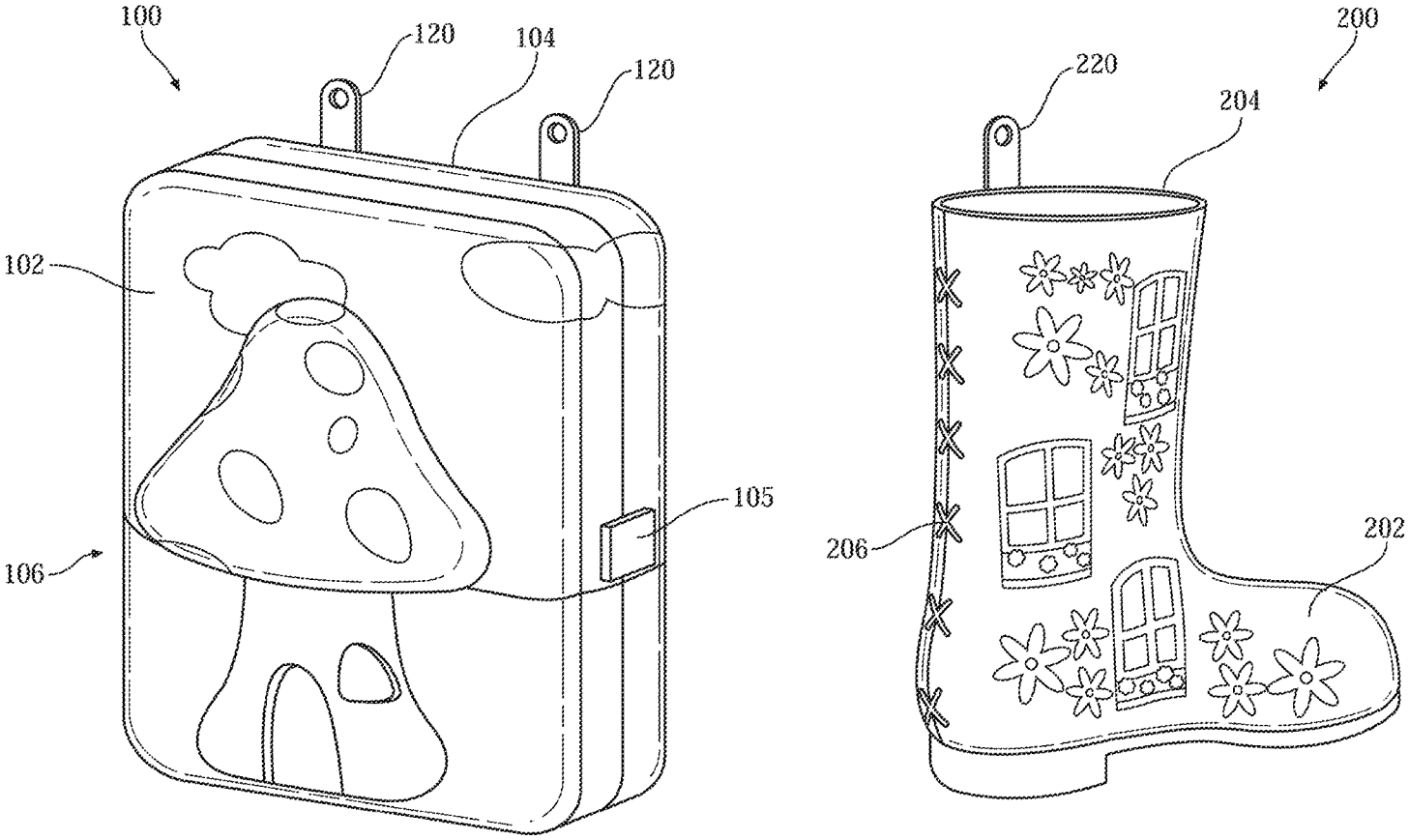
FIG. 1 shows a perspective view of two example wall-mountable toy storage and activity apparatuses with three-dimensional magnetic indicia.

FIG. 1 shows a perspective view of two example wall-mountable toy storage and activity apparatuses 100, 200 with housings forming an interior volume having one or more magnetic interior compartments. Wall-mountable toy storage and activity apparatuses 100, 200 are adapted to removably receive various attachable and interchangeable characters 300 and other magnetic toy models, thereby enabling a user to create a variety of different scenes and imagery thereon. The wall-mountable toy storage and activity apparatuses 100, 200 provides a user entertainment while stimulating their creativity and imagination.

The magnetic interior compartments 112, 114, 212, 213, 214, 215 are three-dimensional in that they include back and bottom surfaces, and generally further include side and top surfaces to form a compartment with an open frontal region. The magnetic interior compartments 112, 114, 212, 213, 214, 215 may include three-dimensional magnetic surfaces suitable for attaching a magnetic toy characters 300 and other magnetic toy models, such as a variety of characters 300, clothing 302, people, places and things, which enable users to create a variety of different scenes and imagery in the interior compartments, thereby entertaining them and stimulating their creativity and imagination. The magnetic interior compartments 112, 114, 212, 213, 214, 215 further provide interior-facing indicia depicting a scene or imagery, such as background imagery representing a room an associated wall coverings, windows, doors, furniture or other items.

Figure 2:
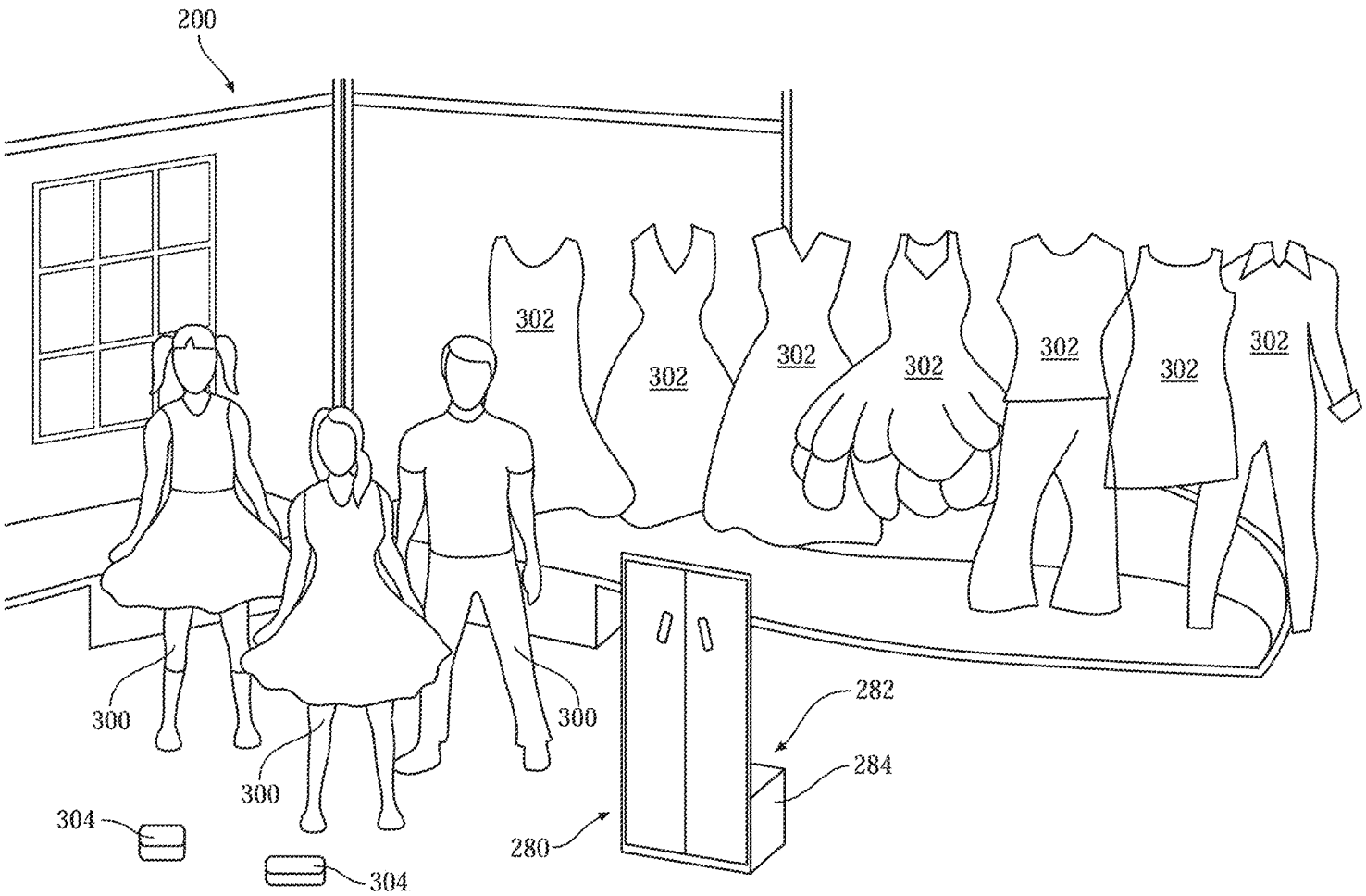
FIG. 2 shows a perspective view of an opened compartment of an example wall-mountable toy storage and activity apparatus with various magnetic characters and their interchangeable accessories.

FIG. 2 shows a perspective view of an opened compartment 214 of wall-mountable toy storage and activity apparatus 200 with various magnetic characters 300 and their interchangeable accessories, including clothing 302, shoes 304 and other accessories. FIG. 2 further shows a removable dresser 280 for storage of magnetic characters 300 and their interchangeable accessories, including clothing 302. Specifically, removable dresser 280 includes an open compartment 282 behind its front facing surface and a rear magnetic surface 284 suitable for attachment to a magnetic interior compartment such as compartment 214.

Figure 3:
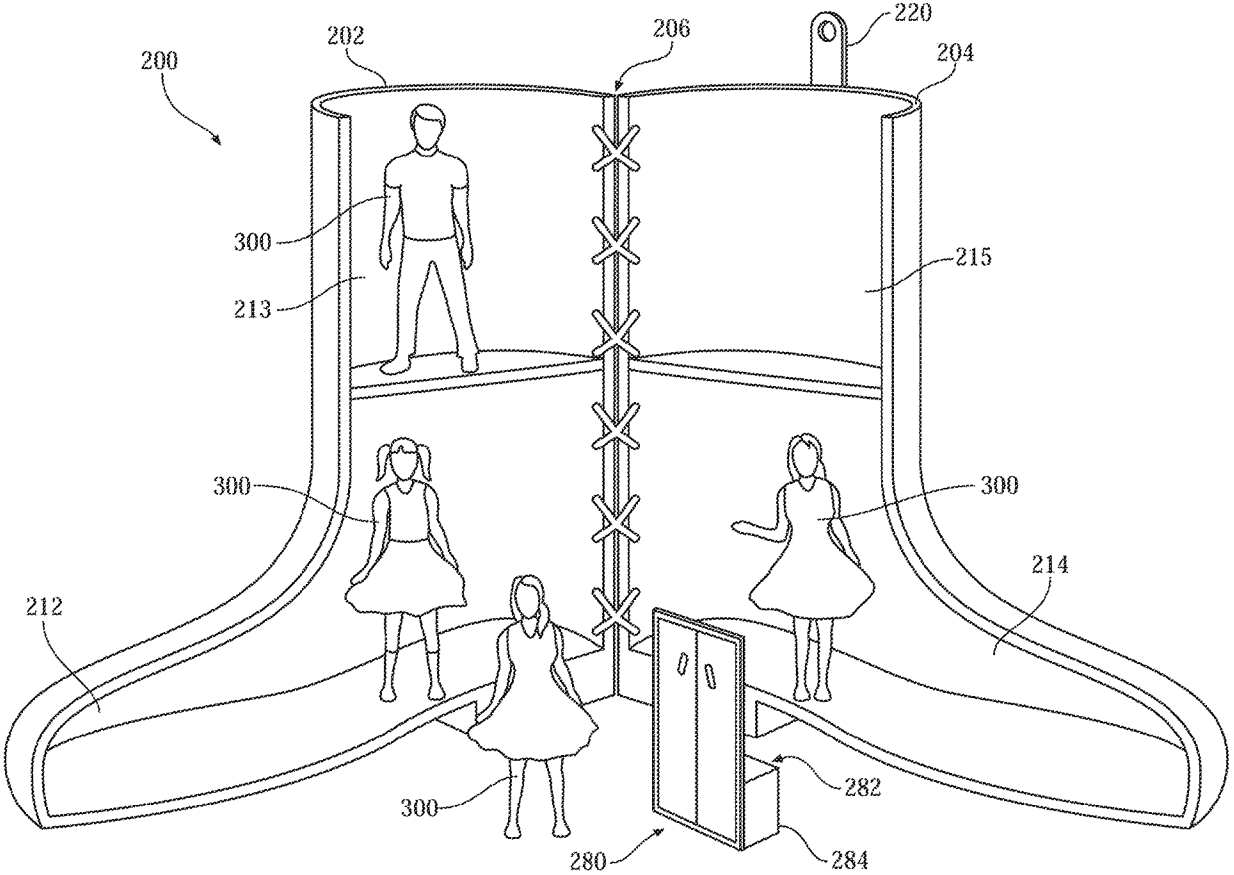
FIG. 3 shows a perspective view of the interior volume and compartments of an example wall-mountable toy storage and activity apparatus.

FIG. 3 shows a perspective view of the interior volume and compartments 212, 213, 214, 215 of wall-mountable toy storage and activity apparatus 200. As shown in FIG. 3, wall-mountable toy storage and activity apparatus 200 includes a housing including a left housing portion 202 and a right housing portion 204 forming an interior volume with compartments 212, 213, 214, 215. Hinged joint 206 connects the left housing portion 202 and the right housing portion 204. The hinged joint 206 enables separation of the housing into an open configuration to provide access to the interior volume and compartments 212, 213, 214, 215.

Compartments 212, 213, 214, 215 are magnetic compartments with magnetic surfaces suitable for attaching a magnetic toy doll 300 and other magnetic toy models. FIG. 3 further shows a removable dresser 280 for storage of magnetic characters 300 and their interchangeable accessories, including clothing 302, as discussed with respect to FIG. 2.

Figure 6:
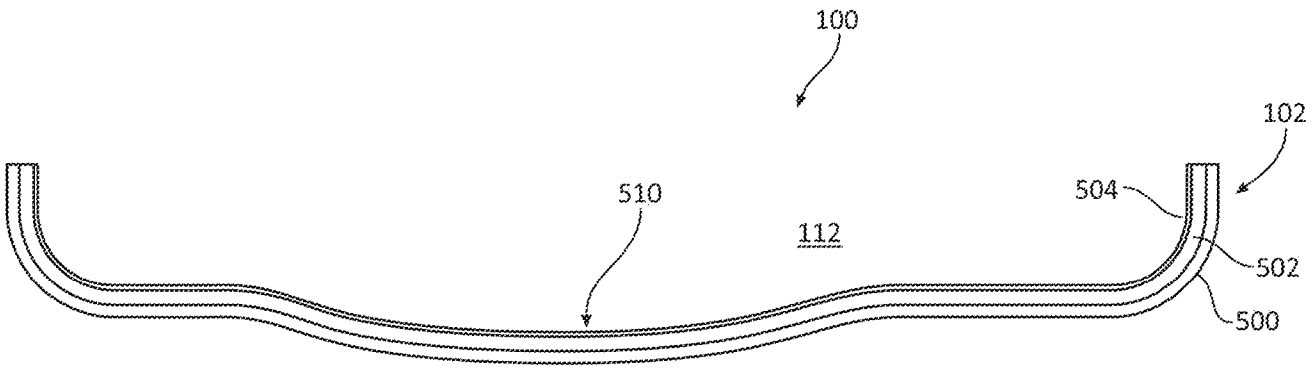
FIG. 6 is a cross-sectional view of a compartment illustrating example layers of a three-dimensional housing of a wall-mountable toy storage and activity apparatus including a durable layer, a magnetic layer and a graphical layer including indicia depicting a scene or imagery.

Referring now to FIG. 3, there is shown a perspective view of the interior volume of the wall-mountable toy storage and activity apparatus 200. The magnetic surfaces of the interior compartments 212, 213, 214, 215 further include interior-facing indicia depicting a scene or imagery. In some examples, the magnetic surfaces of the interior compartments 212, 213, 214, 215 are colorable rather than preprinted or prepainted with imagery, thereby allowing a user the ability to creatively and artistically decorate the interior magnetic surfaces of the interior compartments 212, 213, 214, 215. The left housing portion 202 and the right housing portion 204 may include creases or textures corresponding to the three-dimensional interior-facing indicia, such as crease 510 (FIG. 6).

The interior compartments 212, 213, 214, 215 are arranged in a plurality of stories and/or levels, enabling a user to attach specific indicia as desired in each story. In addition, compartments 212, 213, 214, 215 and interior-facing indicia depicting a scene or imagery are adapted to agree with certain three-dimensional indicia attached thereto, such as a removable dresser 280.

Wall-mountable toy storage and activity apparatus 200 includes one wall-mount fixture 220 on the right housing portion 204. The wall-mount fixture 220 is configured to allow the left housing portion 202 and the right housing portion 204 to be opened along the hinged joint 206 with the toy storage and activity apparatus 200 mounted to a wall 400 via the at least one wall-mount fixture 220. Furthermore, the wall-mountable toy storage and activity apparatus 200 may be configured to remain in an open position, e.g., due to gravity or a latch mechanism, to facilitate playtime with the interior compartments 212, 213, 214, 215 exposed.

Figure 4A:
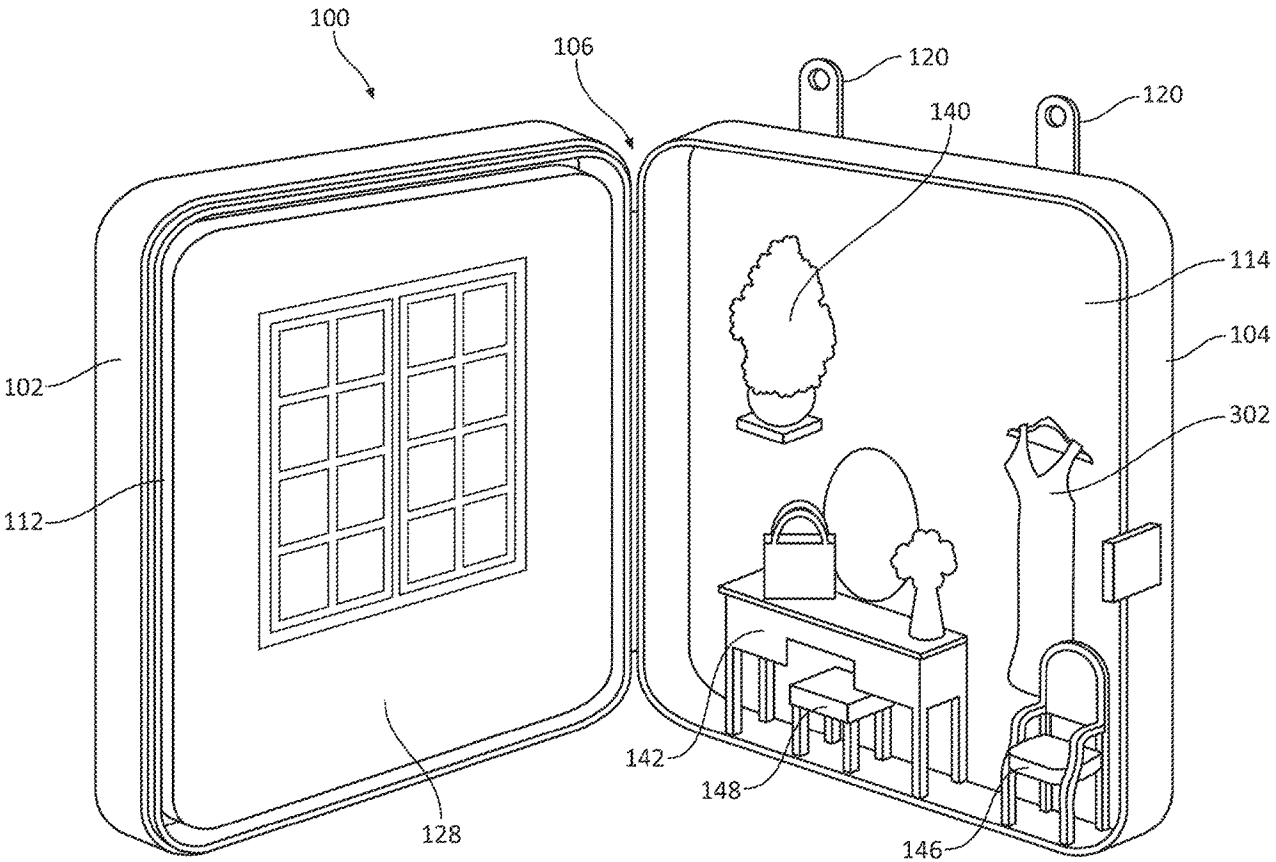
FIGS. 4A and 4B shows perspective views of the interior volume and compartments of an example wall-mountable toy storage and activity apparatus including fold-down elements.
Figure 4B:
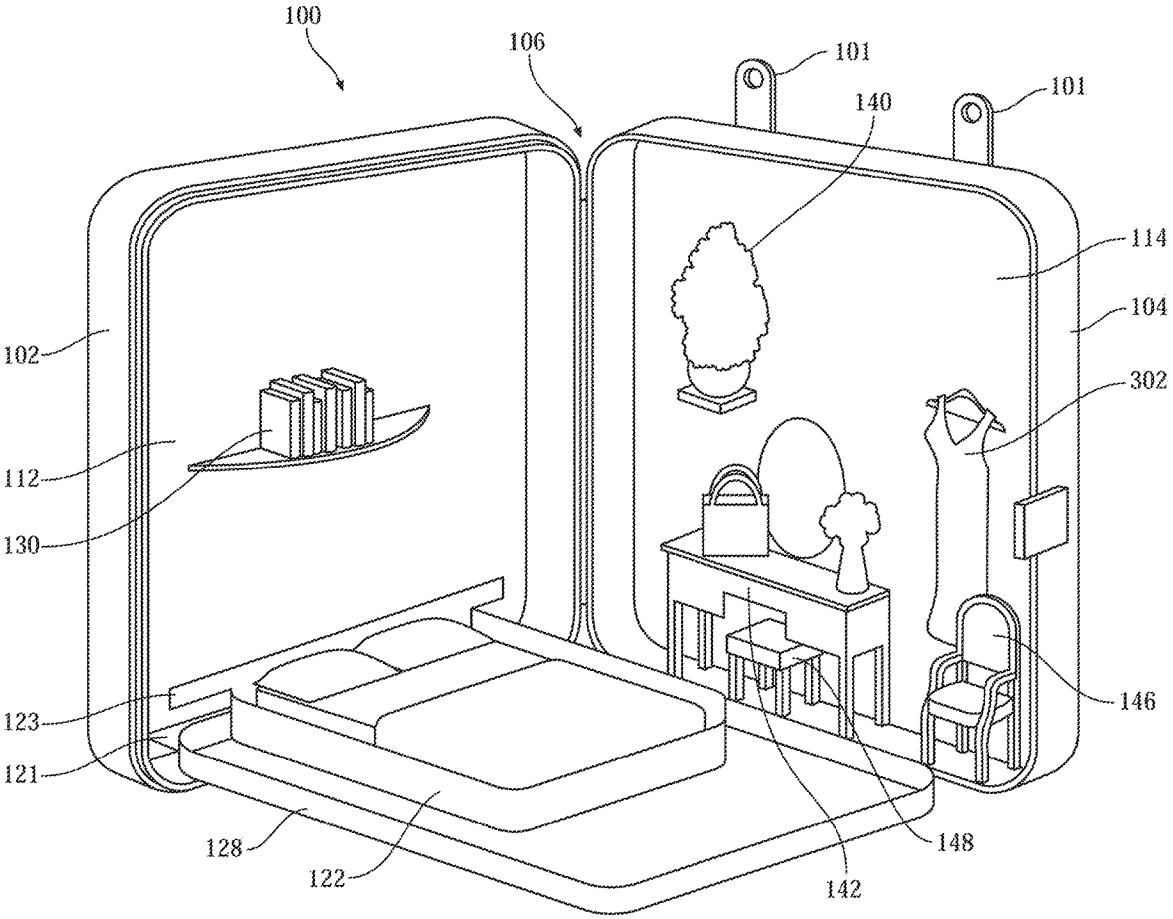

FIGS. 4A and 4B shows perspective views of the interior volume and compartments of an example wall-mountable toy storage and activity apparatus 100. Wall-mountable toy storage and activity apparatus 100 includes compartments 112, 114, and fold-down elements 122, 128.

Wall-mountable toy storage and activity apparatus 100 includes a housing including a left housing portion 102 and a right housing portion 104 forming an interior volume with compartments 112, 114. Hinged joint 106 connects the left housing portion 102 and the right housing portion 104. The hinged joint 106 enables separation of the housing into an open configuration to provide access to the interior volume and compartments 112, 114.

Compartments 112, 114 are magnetic compartments with magnetic surfaces suitable for attaching a magnetic toy doll 300 and other magnetic toy models. In addition, compartments 112, 114 and interior-facing indicia depicting a scene or imagery are adapted to agree with certain three-dimensional indicia attached thereto. FIGS. 4A and 4B further show three-dimensional, indicia including bookshelf 130, flowers 140, desk 142, chair 146 and stool 148, attached to compartments 112, 114. In addition, clothing 302 is attached to an interior three-dimensional magnetic surface of compartment 114.

The magnetic surfaces of the interior compartments 112, 114 further include interior-facing indicia depicting a scene or imagery. In some examples, the magnetic surfaces of the interior compartments 112, 114 are colorable rather than preprinted. The left housing portion 102 and the right housing portion 104 may include creases or textures corresponding to the three-dimensional interior-facing indicia, such as crease 510 (FIG. 6).

Compartment 112 further includes fold-down elements 122, 128. Fold-down element 128 is a foldable floor element connected to a back wall of compartment 112 with hinged joint 121. As shown in FIG. 4A, foldable floor element 128 provides a raised position in general alignment with a wall facing portion of the compartment 112, which facilitates closing the left and right housing portions. The exposed bottom surface 128 of foldable floor element 128 may be a magnetic bottom surface 128 suitable for attaching magnetic characters 300 and other magnetic toy models with the foldable floor element 128 in the raised position. Thus, compartment 112 may represent both an empty room with a window or other imagery as shown in FIG. 4A and a bedroom with bed 122 and bookshelf 130, as shown in FIG. 4B.

As shown in FIG. 4B, foldable floor element 128 provides a lowered position in which the foldable floor element 128 extends outwardly from a bottom portion of the compartment 112 with the toy storage and activity apparatus 100 mounted on the wall. In the example shown, the travel of fold-down element 128 is limited by interference of fold-down element 128 with the back wall of compartment 112. In other examples a tether or other mechanism may be used to secure fold-down element 128 in the lowered position. The bottom portion may then be used as a surface to place two or three-dimensional characters 300, indicia, and other toy models.

With foldable floor element 128 in the lowered position, fold-down element 122, a bed, is exposed and may also be folded down. Fold-down element 122 is a foldable bed connected to a back wall of compartment 112 with hinged joint 123. In the example shown, the travel of fold-down element 122 is limited by interference of fold-down element 122 with the back wall of compartment 112. In other examples a tether or other mechanism may be used to secure fold-down element 122 in the lowered position.

Wall-mountable toy storage and activity apparatus 100 includes two wall-mount fixtures 120 on the right housing portion 104. The wall-mount fixtures 120 are configured to allow the left housing portion 102 and the right housing portion 104 to be opened along the hinged joint 106 with the toy storage and activity apparatus 100 mounted to a wall 400 via the wall-mount fixtures 120. Furthermore, the wall-mountable toy storage and activity apparatus 100 may be configured to remain in an open position, e.g., due to gravity or a latch mechanism, such as fold-down elements 122, 128, to facilitate playtime with the interior compartments 112, 114 exposed. Optional latch 105 is operable to secure the left housing portion 102 and the right housing portion 104 in a closed position.

Figure 5:
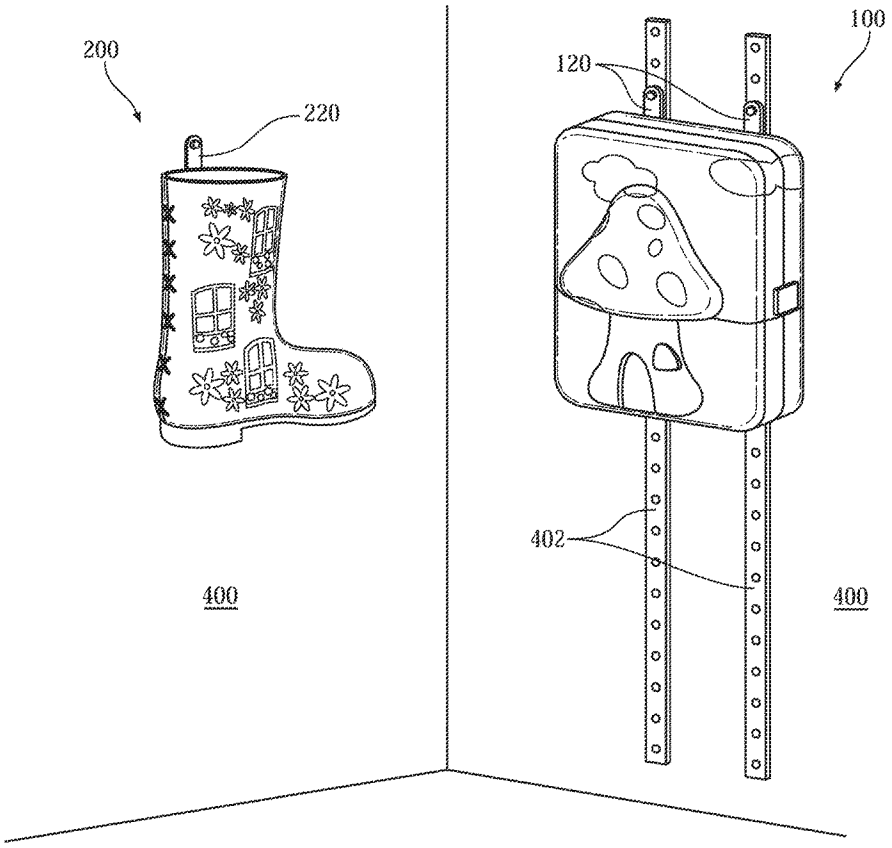
FIG. 5 shows a perspective view of two example wall-mountable toy storage and activity apparatuses mounted on a wall.

FIG. 5 shows a perspective view of wall-mountable toy storage and activity apparatuses 100, 200 mounted on a wall 400 via mounting brackets 120, 220. Wall-mountable toy storage and activity apparatuses 100 is mounted to wall 400 via a track system 402, whereas wall-mountable toy storage and activity apparatuses 200 is mounted directly to wall 400. The mounting brackets 120 are adapted to slidably engage with track system 402 disposed in vertical orientation on a wall, such that wall-mountable toy storage and activity apparatuses 100 may be vertically adjusted to accommodate the height of a user as he or she grows.

In some examples, mounting brackets 120, 220 comprises one or more planar members having apertures, wherein the planar members are attached to the respective housing. The apertures are adapted to receive fasteners, such as screws, therethrough, and or protrusions on track system 402, for mounting the wall-mountable toy storage and activity apparatuses onto a wall.

Interchangeable characters 300 comprise a first surface and a second surface, wherein the first surface comprises a image of a character, person, place, or thing including, but not limited to accessories, houses, flowers, pictures, trees, vehicles, clothes, fantasy lands, air balloons, castles, clouds and the like. The second surface comprises a flat magnetic surface adapted to attach to the one or more magnetic interior compartments of wall-mountable toy storage and activity apparatuses 100, 200. The characters 300 are adapted to provide a user a variety of options such that a user can be creative and construct an artistic image or scene as desired. In one embodiment, the magnetic characters 300 comprise magnetic pictures of the user, such that the user can attach a picture of him or herself to create an imaginary scene in which he or she exists therein. In various examples, the characters 300 can be two-dimensional or three-dimensional. In various examples, one or both of the compartments or the characters 300 and other toy models can include permanent magnets with the other either including another magnetic element such as a permanent magnet or ferromagnetic material.

FIG. 6 a cross-sectional view of compartment 112 illustrating example layers of a three-dimensional housing of a wall-mountable toy storage and activity apparatus. The layers of the housing component, such as components 102, 104, 202, 204, may include a durable layer 500, a magnetic layer 502 and a graphical layer 504 including indicia depicting a scene or imagery.

In different examples, the durable layer 500 includes one or more of: durable plastic, polyvinyl chloride, polycarbonate, durable paper, and cardboard. For example, the durable layer 500 may formed from one or more molded plastic components, such as durable plastic, polyvinyl chloride and polycarbonate. In the same or different examples, the magnetic layer 502 includes magnetic element such as a permanent magnet or ferromagnetic material, incorporated in one or more of: a printable magnetic sheet, a magnetic paint, a magnetic epoxy, magnetic insert within the durable layer. The magnetic layer 502 may represent a paint or epoxy or a thin preprinted paper and/or polymeric layer applied with an adhesive. In the same or different examples, the graphical layer 504 includes one or more of: a printed ink layer, a paint layer, a polymer sticker, and a paper sticker. In this manner, the graphic layer 504 may be a printed layer on the magnetic layer 502 or directly incorporated into magnetic layer 502, i.e., as a paint or epoxy layer.

In various examples, a wall-mountable toy storage and activity apparatus, such as apparatus 100, 200 comprises a housing having an interior volume, wherein the housing may come in a variety of shapes such as spherical, rectangular, and the like. In one embodiment, the housing comprises a square box with an interior volume therein, such as wall-mountable toy storage and activity apparatus 100. In another embodiment, the housing comprises a boot shape box with an interior volume therein, such as wall-mountable toy storage and activity apparatus 200. In one embodiment, the housing is composed of a durable plastic, such as polyvinyl chloride or polycarbonate. In another embodiment, the housing is composed of a durable paper material, such as cardboard.

Various examples of this disclosure have been described. These and other examples are within the scope of the following claims.

What is claimed is:

1. A toy storage and activity apparatus comprising:

a housing including a left housing portion and a right housing portion forming an interior volume; and a hinged joint connecting the left and right housing portions, the hinged joint enabling separation of the housing into an open configuration to provide access to the interior volume, wherein the left and the right housing portions each form one or more magnetic interior compartments within the interior volume, wherein at least one of the compartments within the interior volume further comprises a foldable floor element, wherein the foldable floor element provides a raised position in general alignment with a wall facing portion of the compartment which facilitates closing the left and right housing portions, and a lowered position in which the foldable floor element extends outwardly from a bottom portion of the compartment with the toy storage and activity apparatus mounted on a wall, wherein the magnetic interior compartments have magnetic surfaces suitable for attaching a magnetic toy character and other magnetic toy models, and wherein the magnetic surfaces further include interior-facing indicia depicting a scene or imagery.

2. The toy storage and activity apparatus of claim 1, wherein the magnetic surfaces are three-dimensional magnetic surfaces.

3. The toy storage and activity apparatus of claim 2, wherein the interior-facing indicia are three-dimensional interior-facing indicia.

4. The toy storage and activity apparatus of claim 3, wherein the left and right housing portions include creases or textures corresponding to the three-dimensional interior-facing indicia.

5. The toy storage and activity apparatus of claim 1, wherein the left and right housing portions each include at least two interior compartments are arranged in a plurality of stories, enabling a user to attach specific magnetic toy models as desired in each story.

6. The toy storage and activity apparatus of claim 1, further comprising at least one wall-mount fixture on one of the left and the right housing portions, the at least one wall-mount fixture being configured to allow the left and the right housing portions to be opened along the hinged joint with the toy storage and activity apparatus mounted to a wall via the at least one wall-mount fixture.

7. The toy storage and activity apparatus of claim 1, wherein the left and right housing portions comprise a durable layer, a magnetic layer and graphical layer, the graphical layer providing the interior-facing indicia depicting a scene or imagery.

8. The toy storage and activity apparatus of claim 7, wherein the durable layer includes one or more of a group consisting of:
durable plastic;
polyvinyl chloride;
polycarbonate;
durable paper; and
cardboard.

9. The toy storage and activity apparatus of claim 7, wherein the magnetic layer includes one or more of a group consisting of:
a printable magnetic sheet;
a magnetic paint;
a magnetic epoxy; and
a magnetic insert within the durable layer.

10. The toy storage and activity apparatus of claim 7, wherein the graphical layer includes one or more of a group consisting of:
a printed ink layer;
a paint layer;
a polymer sticker; and
a paper sticker.

11. The toy storage and activity apparatus of claim 1, wherein the foldable floor element includes a magnetic bottom surface suitable for attaching the magnetic toy character and other magnetic toy models with the foldable floor element in the raised position.

12. The toy storage and activity apparatus of claim 1, wherein the housing forms one of a group consisting of:
a square box forming the interior volume; and
a boot shape box forming the interior volume.

13. A toy storage and activity set comprising:
a plurality of magnetic toy characters; and
a toy storage and activity apparatus comprising:
a housing including a left housing portion and a right housing portion forming an interior volume; and
a hinged joint connecting the left and right housing portions, the hinged joint enabling separation of the housing into an open configuration to provide access to the interior volume;
wherein the left and the right housing portions each form one or more magnetic interior compartments within the interior volume,
wherein at least one of the compartments within the interior volume further comprises a foldable floor element,
wherein the foldable floor element provides a first position in general alignment with a wall facing portion of the compartment which facilitates closing the left and right housing portions, and a second position in which the foldable floor element extends outwardly from a bottom portion of the compartment with the toy storage and activity apparatus mounted on a wall,
wherein the magnetic interior compartments have three-dimensional magnetic surfaces suitable for attaching any of the plurality of magnetic toy characters,
and wherein the three-dimensional magnetic surfaces further include interior-facing indicia depicting a scene or imagery.

14. The toy storage and activity set of claim 13, further comprising a plurality of magnetic clothing outfits corresponding to the plurality of magnetic toy characters.

15. The toy storage and activity set of claim 13, further comprising at least one wall-mount fixture on one of the left and the right housing portions, the at least one wall-mount fixture being configured to allow the left and the right housing portions to be opened along the hinged joint with the toy storage and activity apparatus mounted to a wall via the at least one wall-mount fixture.

16. The toy storage and activity set of claim 13, wherein the left and right housing portions comprise a durable layer, a magnetic layer and graphical layer, the graphical layer providing the interior-facing indicia depicting a scene or imagery.

17. The toy storage and activity set of claim 16,
wherein the durable layer includes one or more of a group consisting of:
durable plastic;
polyvinyl chloride;
polycarbonate;
durable paper; and
cardboard,
wherein the magnetic layer includes one or more of a group consisting of:
a printable magnetic sheet;
a magnetic paint;
a magnetic epoxy; and
a magnetic insert within the durable layer, and
wherein the graphical layer includes one or more of a group consisting of:
a printed ink layer;
a paint layer;
a polymer sticker; and
a paper sticker.

18. The toy storage and activity set of claim 13, wherein the housing forms one of a group consisting of:
a square box forming the interior volume; and
a boot shape box forming the interior volume.

19. A toy storage and activity apparatus comprising:
a housing including a left housing portion and a right housing portion forming an interior volume; and
a hinged joint connecting the left and right housing portions, the hinged joint enabling separation of the housing into an open configuration to provide access to the interior volume,
wherein the left and the right housing portions each form one or more magnetic interior compartments within the interior volume,
wherein at least one of the compartments within the interior volume further comprises a foldable floor element,
wherein the foldable floor element provides a raised position in general alignment with a wall facing portion of the compartment which facilitates closing the left and right housing portions, and a lowered position in which the foldable floor element extends outwardly from a bottom portion of the compartment with the toy storage and activity apparatus mounted on a wall.

20. The toy storage and activity apparatus of claim 19, wherein the left and right housing portions comprise a durable layer, a magnetic layer and graphical layer, the graphical layer providing interior-facing indicia depicting a scene or imagery.

21. The toy storage and activity apparatus of claim 20, wherein the durable layer includes one or more of a group consisting of:
durable plastic;
polyvinyl chloride;
polycarbonate;
durable paper; and
cardboard.

22. The toy storage and activity apparatus of claim 20, wherein the magnetic layer includes one or more of a group consisting of:

a printable magnetic sheet;

a magnetic paint;

a magnetic epoxy; and a magnetic insert within the durable layer.

23. The toy storage and activity apparatus of claim 20, wherein the graphical layer includes one or more of a group consisting of:

a printed ink layer;

a paint layer;

a polymer sticker; and a paper sticker.

24. The toy storage and activity apparatus of claim 19, wherein the foldable floor element includes a magnetic bottom surface suitable for attaching a magnetic toy character and other magnetic toy models with the foldable floor element in the raised position.

25. The toy storage and activity apparatus of claim 19, wherein the housing forms one of a group consisting of:

a square box forming the interior volume; and a boot shape box forming the interior volume.

26. The toy storage and activity apparatus of claim 19, wherein the left and right housing portions each include at least two interior compartments are arranged in a plurality of stories, enabling a user to attach specific magnetic toy models as desired in each story.

27. The toy storage and activity apparatus of claim 19, further comprising at least one wall-mount fixture on one of the left and the right housing portions, the at least one wall-mount fixture being configured to allow the left and the right housing portions to be opened along the hinged joint with the toy storage and activity apparatus mounted to a wall via the at least one wall-mount fixture.

* * * * *